US011835891B2

(12) United States Patent
Saito et al.

(10) Patent No.: US 11,835,891 B2
(45) Date of Patent: Dec. 5, 2023

(54) INTERMEDIATE TRANSFER BELT AND IMAGE FORMING APPARATUS

(71) Applicant: CANON KABUSHIKI KAISHA, Tokyo (JP)

(72) Inventors: Shuji Saito, Shizuoka (JP); Hiroyuki Kadowaki, Kanagawa (JP); Hiroomi Kojima, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/938,294

(22) Filed: Oct. 5, 2022

(65) Prior Publication Data

US 2023/0104720 A1 Apr. 6, 2023

(30) Foreign Application Priority Data

Oct. 6, 2021 (JP) ..... 2021-164692

(51) Int. Cl.
*G03G 15/16* (2006.01)
*G03G 15/00* (2006.01)

(52) U.S. Cl.
CPC ..... *G03G 15/162* (2013.01); *G03G 15/5054* (2013.01); *G03G 2215/00059* (2013.01)

(58) Field of Classification Search
CPC ..... G03G 15/162
See application file for complete search history.

(56) References Cited

U.S. PATENT DOCUMENTS

2006/0159494 A1* 7/2006 Hirai ..... G03G 15/1685 399/303
2019/0286016 A1* 9/2019 Hayami ..... G03G 15/162
2019/0302656 A1* 10/2019 Ishizumi ..... G03G 15/5058
2019/0332040 A1* 10/2019 Yokoyama ..... G03G 15/162
2020/0401073 A1* 12/2020 Saito ..... G03G 15/5054

FOREIGN PATENT DOCUMENTS

JP 2019159097 A 9/2019
JP 2019191511 A 10/2019
JP 2020149018 A 9/2020
JP 2021026117 A 2/2021

* cited by examiner

*Primary Examiner* — Carla J Therrien
(74) *Attorney, Agent, or Firm* — Canon U.S.A., Inc. I.P. Division

(57) ABSTRACT

An intermediate transfer belt that can bear a toner image includes a first layer and a second layer. The first layer includes a first surface located on an outer peripheral surface side of the first layer. The second layer is provided on a side of the first surface, transmits light, and includes a second surface. The first surface includes first grooves that (i) extend in a first direction in a circumferential direction of the intermediate transfer belt and (ii) are arranged in a width direction of the intermediate transfer belt that is orthogonal to the circumferential direction. The second surface is located on an outer peripheral surface side of the second layer, contacts a toner image, and includes second grooves that extend in a second direction in the circumferential direction. The first grooves includes 80 or more grooves per 1-mm length in the width direction in the first surface.

13 Claims, 10 Drawing Sheets

INTERMEDIATE TRANSFER BELT AND IMAGE FORMING APPARATUS

BACKGROUND

Field

The present disclosure relates to an intermediate transfer belt and an image forming apparatus using the intermediate transfer belt. The present disclosure particularly relates to an electrophotographic image forming apparatus and an intermediate transfer belt used in the electrophotographic image forming apparatus.

Description of the Related Art

There are known image forming apparatuses, such as Japanese Patent Application Laid-Open No. 2019-191511, that employs an intermediate transfer system with an intermediate transfer member as electrophotographic image forming apparatuses. In a conventional image forming apparatus with an intermediate transfer system, a toner image formed on a photosensitive drum serving as an image bearing member is primarily transferred to an intermediate transfer member, and then, the toner image on the intermediate transfer member is secondarily transferred onto a recording material. Endless intermediate transfer belts are widely used as intermediate transfer belts.

In an image forming apparatus with the intermediate transfer system, toner (secondary transfer residual toner) remains on the intermediate transfer belt after the secondary transfer process. This entails a cleaning process of removing the secondary transfer residual toner from the intermediate transfer belt before the next image is transferred to the intermediate transfer belt.

Meanwhile, blade cleaning systems are widely used in the cleaning process. In a conventional blade cleaning system, the secondary transfer residual toner is physically scraped from the moving intermediate transfer belt by the cleaning blade disposed downstream of the secondary transfer portion in the moving direction (hereinafter referred to as "belt conveyance direction") of the surface of the intermediate transfer belt.

In general, the cleaning blade is made of urethane rubber or another elastic member. The cleaning blade is disposed so that its free end extends toward upstream of the rotation direction (the moving direction of the surface) of the intermediate transfer belt, and the edge of its free end can be brought into pressure contact with the intermediate transfer belt.

There has been discussed a configuration that reduces the frictional force between an intermediate transfer belt and a cleaning blade by forming a predetermined shape on the surface of the intermediate transfer belt, to increase durability.

Specifically, the coefficient of friction between the cleaning blade and the surface of the intermediate transfer belt is reduced by forming grooves at intervals of 2 μm to 10 μm in the surface of the intermediate transfer belt.

SUMMARY

The present disclosure is directed to providing forms of an intermediate transfer belt for bearing toner images and an image forming apparatus that work towards maintaining surface frictional resistance of the intermediate transfer belt low, and providing a high accuracy of detection by an optical sensor.

According to an aspect of the present disclosure, an intermediate transfer belt having an endless shape and configured to bear a toner image includes a first layer that includes a first surface located on an outer peripheral surface side of the first layer, and a second layer that is provided on a side of the first surface, is configured to transmit light, and includes a second surface, wherein the first surface includes a plurality of first grooves that (i) extends in a first direction in a circumferential direction of the intermediate transfer belt and (ii) is arranged in a width direction of the intermediate transfer belt that is orthogonal to the circumferential direction, wherein the second surface is located on an outer peripheral surface side of the second layer, is configured to be in contact with a toner image, and includes a plurality of second grooves that extends in a second direction in the circumferential direction, and wherein the plurality of first grooves includes 80 or more grooves per 1-mm length in the width direction in the first surface.

Further features of the present disclosure will become apparent from the following description of exemplary embodiments with reference to the attached drawings.

DESCRIPTION OF THE EMBODIMENTS

An image forming apparatus 100 and an intermediate transfer belt 8 used in the image forming apparatus 100 according to an exemplary embodiment of the present disclosure will be described below. The present disclosure is not limited to the following exemplary embodiment, unless otherwise specified.

(Configuration of Image Forming Apparatus)

Figure 1:
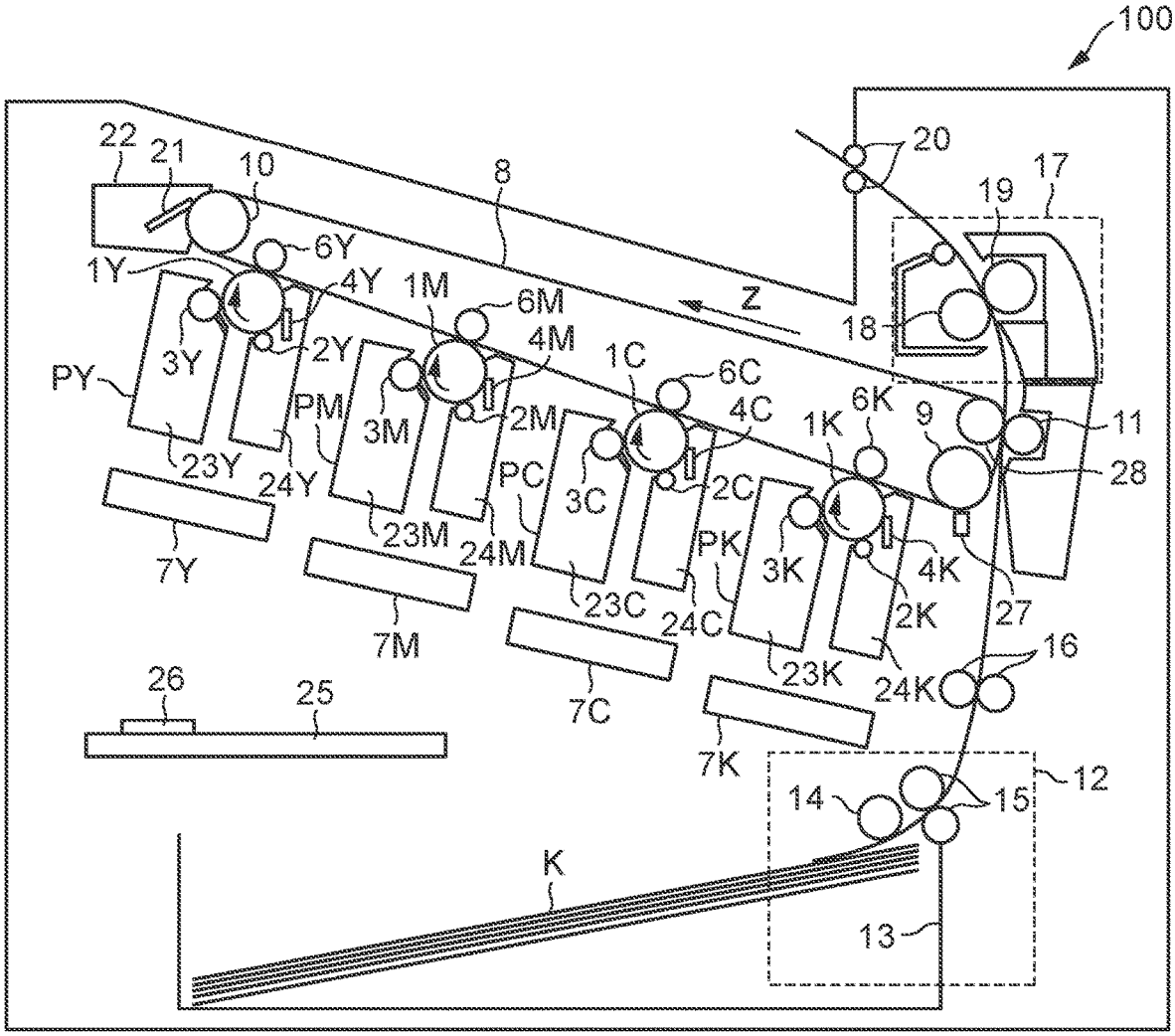
FIG. 1 is a conceptual cross-sectional view of an image forming apparatus according to an exemplary embodiment of the present disclosure.

FIG. 1 is a conceptual cross-sectional view of the image forming apparatus 100 according to the present exemplary embodiment of the present disclosure.

Specifically, FIG. 1 illustrates a longitudinal cross-section of the image forming apparatus 100 of the present exemplary embodiment in sight of the front. In the following description, letters YMCK each attached to the end of a reference numeral indicate the color of toner, and will be omitted for descriptions common to the four colors.

The image forming apparatus 100 is an electrophotographic laser beam printer that forms images at a process speed of 210 mm/s and a resolution of 600 dpi and supports Legal size paper sheets.

The image forming apparatus 100 illustrated in FIG. 1 includes four process cartridges P that are detachably attached. These four process cartridges P has a common structure. However, the four process cartridges P are different in color of toner contained therein, i.e., different in that the process cartridges P form images using toners of yellow (Y), magenta (M), cyan (C), and black (K).

The process cartridges P each have a toner container 23. The process cartridges P each further have a photosensitive drum 1 as an image bearing member. The process cartridges P each further have a charging roller 2, a development roller 3, a drum cleaning blade 4, and a waste toner container 24.

Laser units 7 are disposed below each of the process cartridges P, and performs exposure on the photosensitive drums 1 based on image signals. Each photosensitive drum 1 is charged to a predetermined potential of negative polarity with a predetermined voltage of negative polarity applied to the corresponding charging roller 2, and the corresponding laser unit 7 forms an electrostatic latent image on the corresponding photosensitive drum 1. This electrostatic latent image is subjected to reversal development with a predetermined voltage of negative polarity applied to the corresponding development roller 3, forming a toner image on the corresponding photosensitive drum 1.

Each toner used in the present exemplary embodiment is formed with externally added silica microparticles having an average particle diameter of 20 nm to toner particles having an average particle diameter of 5.4 μm, and is charged to negative polarity. The average particle diameter is determined based on the particle volume, which can be measured, for example, by the Coulter method.

An intermediate transfer belt unit includes the intermediate transfer belt 8, a drive roller 9, a tension roller 10 serving as a stretching roller, and a facing roller 28.

The intermediate transfer belt 8 is an endless belt formed with an added conductive agent to a resin material to give conductivity, and has a length (hereinafter referred to as longitudinal length) of 250 mm in the depth direction in FIG. 1 and a circumferential length of 712 mm. The intermediate transfer belt 8 is stretched by three rollers; the drive roller 9 with a diameter of 24 mm and a longitudinal length of 240 mm, the tension roller 10 with a diameter of 24 mm and a longitudinal length of 250 mm, and the facing roller 28 with a diameter of 16 mm and a longitudinal length of 240 mm. Further, the intermediate transfer belt 8 is stretched with a tension (total pressure) of 100 N by the tension roller 10. The configuration of the intermediate transfer belt 8 will be described in detail below.

Inside the intermediate transfer belt 8, a primary transfer roller 6 is disposed as a primary transfer member to face the corresponding photosensitive drum 1, and a transfer voltage is applied to the primary transfer roller 6 by a voltage application unit (not illustrated).

An optical sensor 27 is disposed at either position 100 mm away from the central position of the intermediate transfer belt 8 in a width direction Z3. The optical sensor 27 detects calibration patches that are a test image formed on the intermediate transfer belt 8, using the drive roller 9 as a facing member. The configuration of the optical sensor 27 will be described in detail below.

First, the photosensitive drums 1 each rotate in the arrow direction, moving the toner image formed on the photosensitive drum 1.

Subsequently, the intermediate transfer belt 8 is rotated in an arrow-Z direction by an intermediate transfer belt drive unit (not illustrated), and a voltage of positive polarity is applied to the corresponding primary transfer roller 6, primarily transferring the toner image onto the intermediate transfer belt 8. The toner images are sequentially transferred onto the intermediate transfer belt 8 starting from the toner image on the photosensitive drum 1Y, and the four-color toner images in an overlapping state are conveyed to the secondary transfer portion (a secondary transfer nip) formed by a secondary transfer roller 11 serving as a secondary transfer member and the facing roller 28.

A feeding conveyance device 12 has a sheet feeding roller 14 for feeding a recording material K from a sheet feeding cassette 13 containing the recording material K, and a conveyance roller pair 15 for conveying the fed recording material K. The recording material K conveyed from the feeding conveyance device 12 is conveyed to the secondary transfer portion by a registration roller pair 16.

A voltage of positive polarity is applied to the secondary transfer roller 11 to transfer the toner images from the intermediate transfer belt 8 to the recording material K. The toner images on the intermediate transfer belt 8 can be thereby secondarily transferred to the recording material K being conveyed. The recording material K on which the toner images are transferred is conveyed to a fixing device 17, and heated and pressed by a fixing film 18 and a pressure roller 19, so that the toner images are fixed on the surface of the recording material K. The recording material K after the fixing is discharged by a discharge roller pair 20.

After the toner images are transferred to the recording material K, each drum cleaning blade 4 removes primary-transfer residual toner remaining on the surface of the corresponding photosensitive drum 1.

Further, as the intermediate transfer belt 8 rotates (moves) in the arrow-Z direction, secondary-transfer residual toner is scraped by a cleaning blade 21 serving as a cleaning member, and the scraped toner is collected into a waste toner collection container 22.

The cleaning blade 21 is composed of a urethane rubber blade having a longitudinal length of 230 mm, a thickness of 2 mm, and a hardness of 77 degrees in Japanese Industrial Standards (JIS) K6253 attached to a galvanized steel sheet having a longitudinal length of 240 mm and a thickness of 3 mm. The free end of the cleaning blade 21 is in contact with the outer peripheral surface of the intermediate transfer belt 8, and extends upstream in the moving direction (the arrow-Z direction) of the intermediate transfer belt 8. The cleaning blade 21 is pressed via the intermediate transfer belt 8 against the tension roller 10 with a linear pressure of 0.49 N/cm and a total pressure of about 11.3 N.

A control board 25 is a board on which electric circuitry for controlling the image forming apparatus 100 is mounted, and a central processing unit (CPU) 26 is mounted on the control board 25 as a control unit. The CPU 26 controls an intermediate transfer belt drive motor serving as a drive source for the intermediate transfer belt 8 related to the conveyance of the recording material K, drive sources (not illustrated) for the feeding conveyance device 12, the registration roller pair 16, and the fixing device 17, and other components. The CPU 26 also comprehensively controls the operations of the image forming apparatus 100, including the control of a drum motor (not illustrated) serving as a drive source for the process cartridge P, the control of various image signals related to image forming, the control of density correction based on detection results of the optical sensors 27, and further, control related to failure detection.

(Optical Sensor Configuration)

The optical sensors 27 used in the image forming apparatus 100 of the present exemplary embodiment will be described with reference to FIG. 2.

Figure 2:
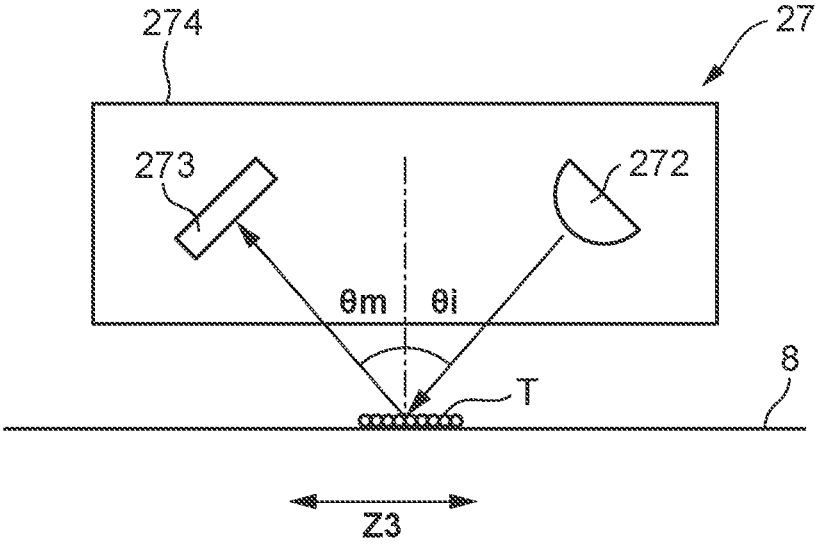
FIG. 2 is a conceptual cross-sectional view of an optical sensor used in the image forming apparatus according to the exemplary embodiment of the present disclosure.

FIG. 2 is a conceptual cross-sectional view of each optical sensor 27 used in the image forming apparatus 100 according to the exemplary embodiment of the present disclosure.

Specifically, FIG. 2 illustrates a cross-section of each optical sensor 27 and the intermediate transfer belt 8 in the width direction Z3 of the intermediate transfer belt 8.

Each optical sensor 27 includes a light emitting element 272 such as a light emitting diode (LED), a regularly reflected light receiving element 273 including a photodiode, and a holder 274, as illustrated in FIG. 2.

The light emitting element 272 uses near-infrared LED light having a center wavelength $\lambda$=840 nm, and emits the near-infrared LED light onto the surface of the intermediate transfer belt 8 at an angle of incidence $\theta i$=—20° when the normal direction of the intermediate transfer belt 8 is 0°. With this configuration, the regularly reflected light receiving element 273 can receive the reflected light at an angle of reflection $\theta m$=20°.

The regularly reflected light receiving element 273 measures reflected light from the surface of the intermediate transfer belt 8 or a calibration patch T onto which light is emitted from the light emitting element 272, which allows a detection of the position of the calibration patch T.

Next, an output characteristic of the optical sensor 27 will be described with reference to FIG. 3.

Figure 3:
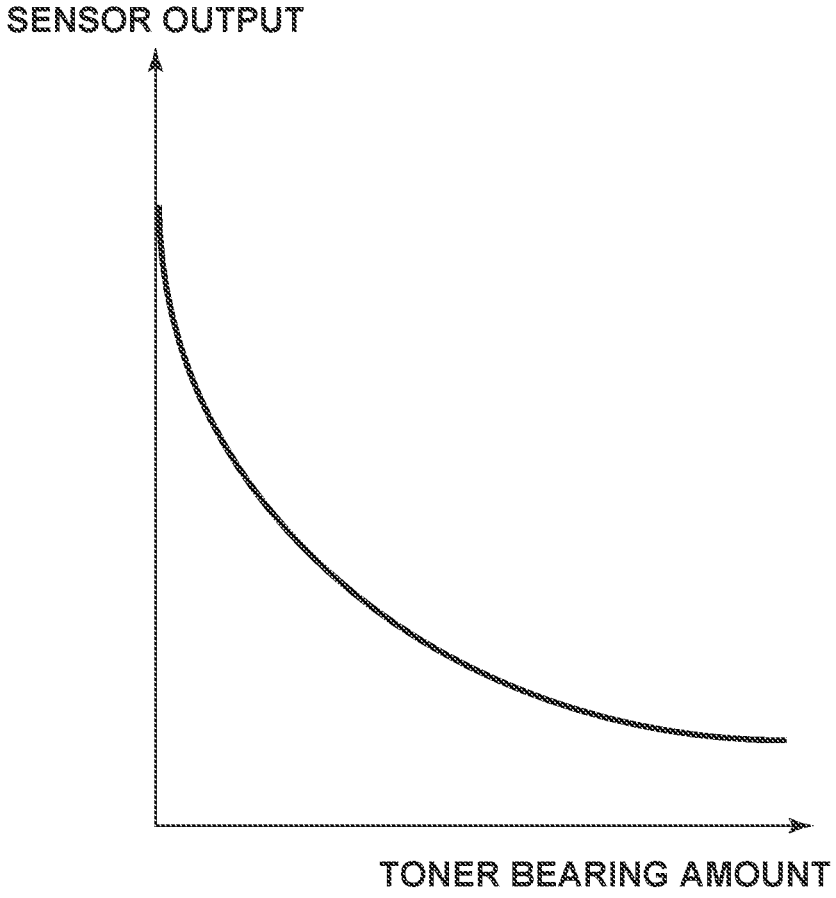
FIG. 3 is a conceptual diagram illustrating a reflection property of the optical sensor in the exemplary embodiment of the present disclosure.

FIG. 3 is a conceptual diagram illustrating a reflection property of the optical sensor in the exemplary embodiment of the present disclosure.

Specifically, FIG. 3 illustrates the relationship between amounts of toner borne on the intermediate transfer belt 8 and outputs of the optical sensor 27.

As the amount of toner borne on the intermediate transfer belt 8 increases, the regularly reflected light from the surface of the intermediate transfer belt 8 decreases. It is because the toner scatters the emitted light more and more as the amount of toner borne on the intermediate transfer belt 8 increases while a more surface (outer peripheral surface) of the intermediate transfer belt 8 as a base is covered with more amounts of the toner simultaneously. The position of the calibration patch T on the intermediate transfer belt 8 can be detected by such a difference in output of reflected light.

(Calibration Control)

Next, calibration control will be described with reference to FIG. 4.

Figure 4:
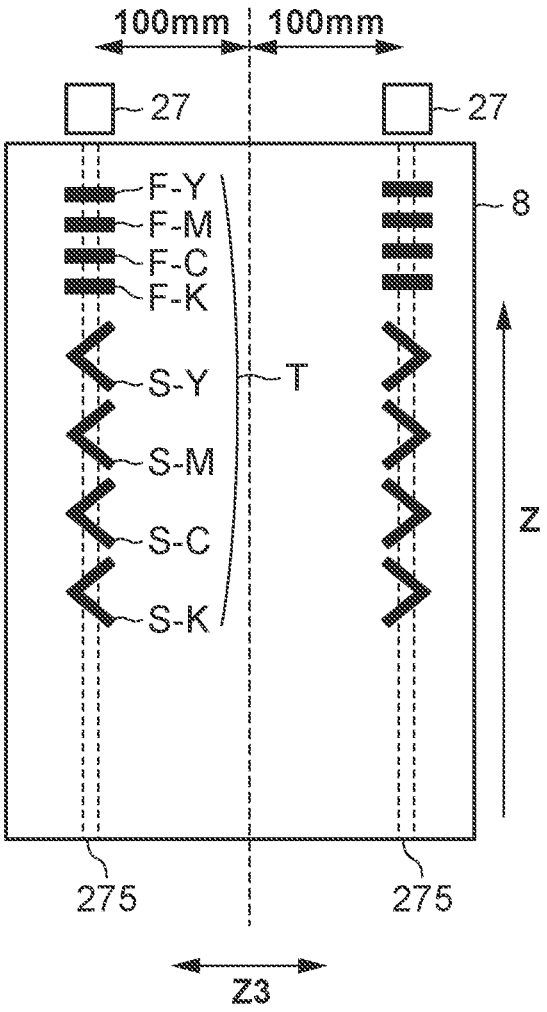
FIG. 4 is a conceptual diagram illustrating the positional relationship between the optical sensor and a position detection pattern in the exemplary embodiment of the present disclosure.

FIG. 4 is a conceptual diagram illustrating the positional relationship between the optical sensors and a position detection pattern in the exemplary embodiment of the present disclosure.

Specifically, FIG. 4 illustrates the positional relationship between the optical sensors 27 and the calibration patch T.

As described above, the optical sensors 27 are disposed at the positions 100 mm away from the central position of the intermediate transfer belt 8 in the width direction Z3 to detect the calibration patch T formed on left and right (in the width direction) on the intermediate transfer belt 8.

A first area 275 represents an area that can be detected by the corresponding optical sensor 27. In the present exemplary embodiment, each optical sensor 27 (the light emitting element 272) can receive (detect) the emitted and reflected light in a range of the emission width (the width direction Z3) of 2 mm of the emission over the entire circumference (a circumferential direction Z) as the intermediate transfer belt 8 rotates.

In the present exemplary embodiment, the calibration patch T is formed of a position detection pattern F in the rotation (circumferential) direction Z (hereinafter referred to as the sub scanning direction Z) of the intermediate transfer belt 8, and a position detection pattern S in the width direction Z3 (hereinafter referred to as the main scanning direction Z3) of the intermediate transfer belt 8. The images of both of these patterns are formed in order of yellow, magenta, cyan, and black.

Next, a technique for detecting a pattern position based on the calibration patch will be described in detail with reference to FIG. 5.

Figure 5:
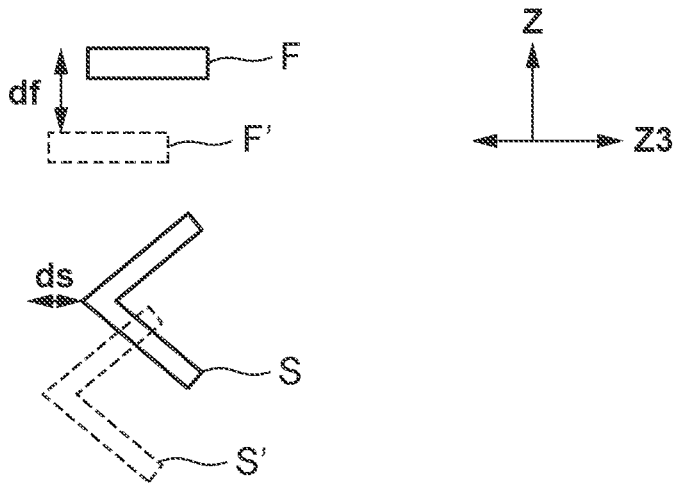
FIG. 5 is a conceptual diagram illustrating a method for calculating the amount of positional difference in the exemplary embodiment of the present disclosure.

FIG. 5 is a conceptual diagram illustrating a method for calculating the amount of positional difference in the exemplary embodiment of the present disclosure.

Specifically, FIG. 5 illustrates an actually drawn position with respect to the ideal position of the calibration patch and the amount of difference therefrom.

Here, "the amount of difference" indicates the amount of difference between the actually detected position and the ideal position or detection timing.

The ideal position or detection timing is determined based on a specific reference. As the specific reference, the position where or the timing when a mark at a reference position on the intermediate transfer belt 8 or a reference color is detected can be set.

Next, the detection of a pattern positional difference in the sub scanning direction Z will be described with reference to "pattern F" illustrated in FIG. 5.

In FIG. 5, "pattern F" is an actually formed position detection pattern in the sub scanning direction Z. Meanwhile, "pattern F'" illustrated in FIG. 5 is a pattern at the ideal position (i.e., "the difference is 0").

Here, if the timing when the pattern F is detected by the corresponding optical sensor 27 is "t", and the timing when the ideal pattern F' is supposed to be detected is "t", "difference df" in the sub scanning direction Z can be calculated by the following equation. $df=(t-t')\times ps$ (where ps is a surface moving speed of the intermediate transfer belt)

Next, the detection of a positional difference in the main scanning direction Z3 will be described.

In FIG. 5, "pattern S" is an actually formed position detection pattern in the main scanning direction Z3. Meanwhile, "pattern S" illustrated in FIG. 5 is a pattern at the ideal position (i.e., "the difference is 0").

In the present exemplary embodiment, "pattern S" is a pattern of a "<" shape formed of two lines intersecting at an angle of 90 degrees, and the angles of lines are 45 degrees with respect to the sub scanning direction Z. As the two lines passes under the corresponding optical sensor 27, let t1 denote a first passage timing and t2 denote a second passage timing.

Similarly, when the timings when the ideal pattern S' is supposed to be detected are "t1'" and "t2'", "registration difference ds" in the main scanning direction Z3 can be calculated by the following equation.

$$ds=\tfrac{1}{2}\times\{(t2'-t1')-(t2-t1)\}\times ps$$ (where $ps$ is a surface moving speed of the intermediate transfer belt)

Next, a technique for detecting the timing when the calibration patch T has passed under the corresponding optical sensor 27 will be described in detail with reference to FIG. 6.

Figure 6:
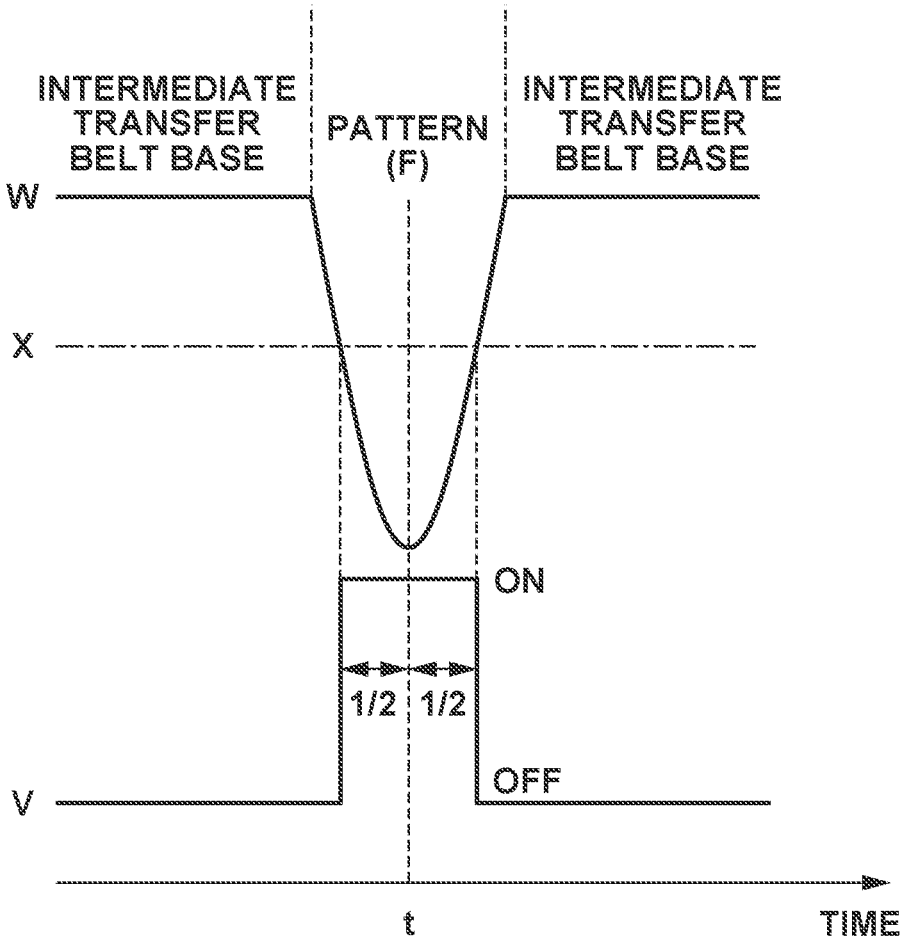
FIG. 6 is a conceptual diagram illustrating the correspondence relationship between a position detection pattern and an output waveform from the optical sensor in the exemplary embodiment of the present disclosure.

FIG. 6 is a conceptual diagram illustrating a correspondence between a position detection pattern and an output waveform from an optical sensor in the exemplary embodiment of the present disclosure.

Specifically, FIG. 6 illustrates an output (a waveform W) when the position detection pattern F in the sub scanning direction Z passes under the corresponding optical sensor 27.

When the optical sensor 27 detects a portion (the base of the intermediate transfer belt 8) other than the position detection pattern F, the amount of reflected light incident on the regularly reflected light receiving element 273 is large, and thus the sensor output is large. When the position detection pattern F passes under the optical sensor 27 (the first area that is a range to be detected thereby), the amount of reflected light incident on the regularly reflected light receiving element 273 is small since the toner is present (covers), and the sensor output is also small.

On the other hand, the waveform W of the sensor output is output as "digital signal V" output through a comparison circuit (not illustrated) of the control board 25.

As illustrated in FIG. 6, a dotted line X represents a threshold for determining ON/OFF in the comparison circuit, and the digital signal V output from the comparison circuit is ON when the digital signal V is less than or equal to the threshold (the dotted line X). The CPU 26 refers to the digital signal V, and measures the time period from when the signal switches to "ON" to when the signal returns to "OFF", and further detects the timing at half of the time period in which the signal is "ON" as the timing "t" when the optical sensor 27 detects the position detection pattern F.

Subsequently, the CPU 26 calculates "difference df" in the sub scanning direction Z based on the difference between the detected timing "t" and the timing "t" when the ideal pattern F is supposed to be detected.

Further, in the present exemplary embodiment, after the amount of positional difference is detected, the positional difference is corrected. The positional difference is corrected by an image forming condition being corrected based on the amount of difference detected.

Specifically, the image forming position of each color can be brought close to the ideal position through adjustment of the timing for sending out individual image signals for Y, M, C, and K. In addition, in the present exemplary embodiment, the detection and correction of the amount of difference in the sub scanning direction is described, but the difference in the main scanning direction, the difference in inclination in the main scanning direction, and another difference can be corrected likewise, based on a difference in terms of the detection timing of a pattern.

(Intermediate Transfer Belt Configuration)

Next, the configuration of the intermediate transfer belt 8 of the present exemplary embodiment will be described with reference to FIGS. 7A and 7B.

Figure 7A:
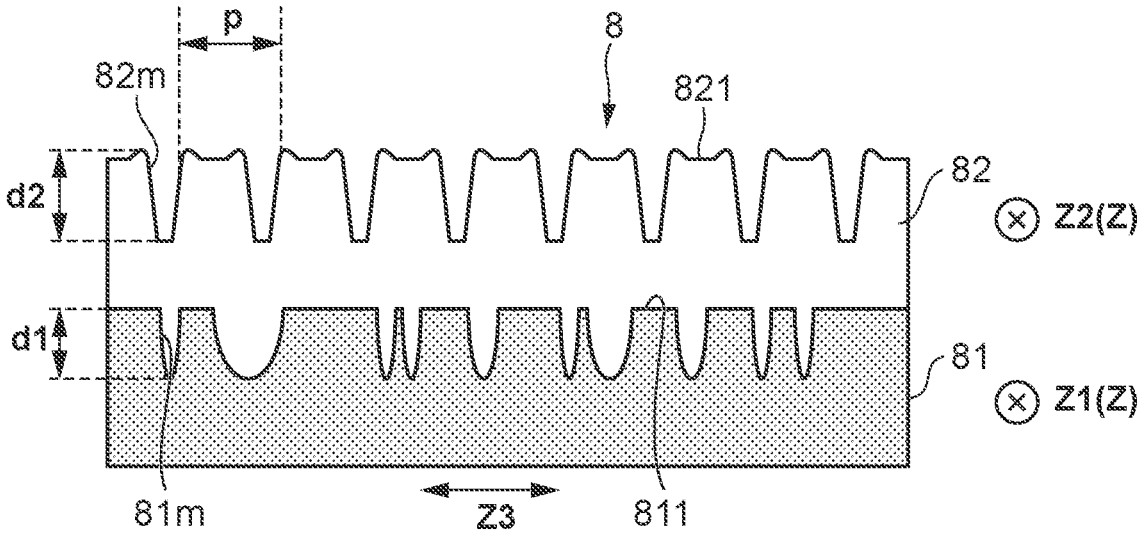
FIG. 7A is an enlarged conceptual diagram illustrating the cross-section of an intermediate transfer belt having a bulging shape at its groove end portion, according to the exemplary embodiment of the present disclosure.
Figure 7B:
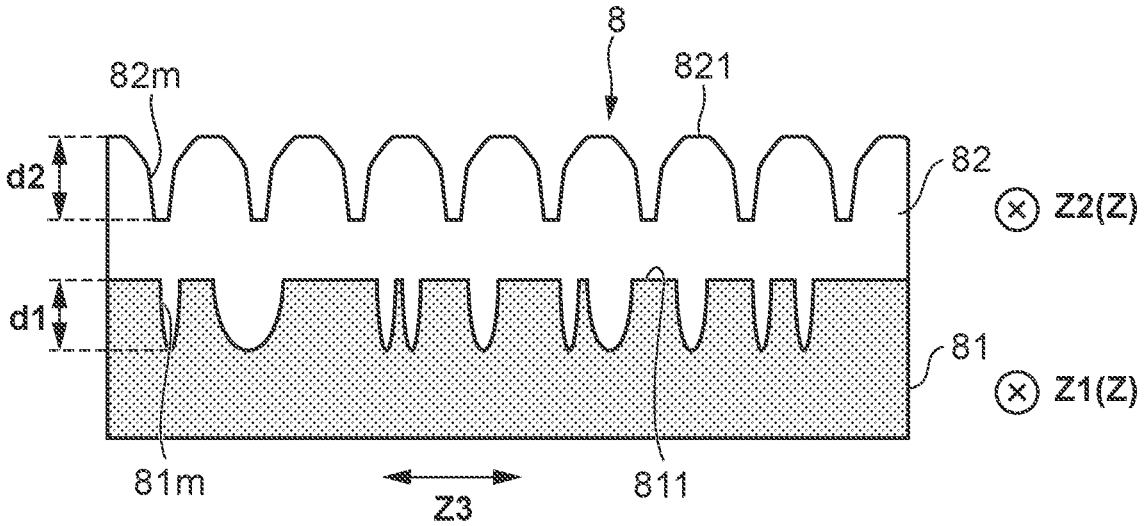
FIG. 7B is an enlarged conceptual diagram illustrating the cross-section of the intermediate transfer belt having a groove shape different from the shape in FIG. 7A, according to the exemplary embodiment of the present disclosure.

FIGS. 7A and 7B are enlarged conceptual diagrams each illustrating a cross-section of the intermediate transfer belt 8 according to the exemplary embodiment of the present disclosure.

Specifically, FIGS. 7A and 7B each schematically illustrate an enlarged area of about 30 μm of the intermediate transfer belt 8 in the direction (the width direction Z3) substantially orthogonal to the belt circumferential direction Z.

As illustrated in FIGS. 7A and 7B, in the present exemplary embodiment, the intermediate transfer belt 8 is an endless belt member and consists of two layers, namely, a base layer 81 as a first layer and an outer layer 82 as a second layer.

In a base layer surface 811 (a first surface) that is a surface on one side of the base layer 81 in the thickness direction, a plurality of minute vertical grooves 81*m* is formed extending in a first direction Z1 in the circumferential direction Z.

In addition, in an outer layer surface 821 (a second surface) that is a surface on the other side opposite to the base layer 81 side in the thickness direction of the outer layer 82, a plurality of minute vertical grooves 82*m* is formed extending in a second direction Z2 in the circumferential direction Z.

In the present exemplary embodiment, the first direction Z1 and the second direction Z2 are both the same direction as the circumferential direction Z, but may not be the same direction if these directions are in the circumferential direction Z. For example, the first direction Z1 and the second direction Z2 can have a crossing angle of 15° or less with respect to the circumferential direction Z.

Further, in the present exemplary embodiment, the intermediate transfer belt 8 may further have a third layer as a layer opposite the second layer with the first layer.

As a technique for forming a microgroove shape in the surface of the base layer 81, processing using a lapping film is used in the present exemplary embodiment. In addition, as a technique for forming a microgroove shape in the surface of the outer layer 82, imprint processing is used in the present exemplary embodiment. The microgroove shapes will be described below.

The layer structure of the intermediate transfer belt 8 of the present exemplary embodiment will be described below in detail.

The base layer 81 serving as the first layer is made of an ion conductive agent as the conductive agent added to polyethylene naphthalate (PEN) resin and polyether-ester amide (PEEA), and by extrusion molding. The first layer is a layer having a seamless belt shape and has a thickness of 60 μm and a volume resistivity of 1×10^10 Ω·cm. While the PEN and PEEA resins are used as the materials of the base layer 81, other materials may be used if these materials are thermoplastic resins. For example, materials such as polyester, polycarbonate, polyarylate, polyetherether ketone, acrylonitrile-butadiene-styrene copolymer (ABS), polyphenylene sulfide (PPS), and polyvinylidene fluoride (PVdF) may be used. Further, resin obtained by mixing these materials may be used.

As the ion conductive material serving as the conductive agent of the base layer 81, alkali metal salt is used.

The thickness of the base layer 81 is desirably 30 μm or more, to reduce deformation and creases attributable to the imprint processing.

The outer layer 82 serving as the second layer is a transparent acrylic resin layer having a thickness of 2 μm, and is formed through dip-coating of the base layer 81 in a curable composition and then ultraviolet emission. The curable composition is formed by dissolving/dispersing a multifunctional acrylic monomer, a photopolymerization initiator, and conductive metal oxide particles in a solvent. As the coating method for the outer layer 82, another type of method such as spray coating, flow coating, shower coating, roll coating, or spin coating may be used, as long as a uniform film can be formed. Further, if the outer layer 82 has a thickness of 3 μm or more, the outer layer 82 will crack (break) because of a curvature at the time of belt stretching. It thus is suitable that the thickness is 3 μm or less to prevent such cracking.

The microgroove shape formed in the belt surface by the imprint processing will be described in detail with reference to FIGS. 7A and 7B.

In general, when urethane rubber and acrylic resin rub against each other, a blade squeak or turn-up of the cleaning blade is likely to occur. In the present exemplary embodiment, vertical grooves each serving as a second groove are formed in the surface of the outer layer 82 at a predetermined pitch (the number of grooves) in the belt circumferential direction. In the present exemplary embodiment, the groove pitch indicated as a distance p in FIG. 7A is obtained by measuring the distance between the starting points of adjacent projections. The number of grooves is obtained by calculating the number of grooves per 1 mm based on the average of the groove distances p.

Next, the details of the imprint processing will be described with reference to FIGS. 8A and 8B.

Figure 8A:
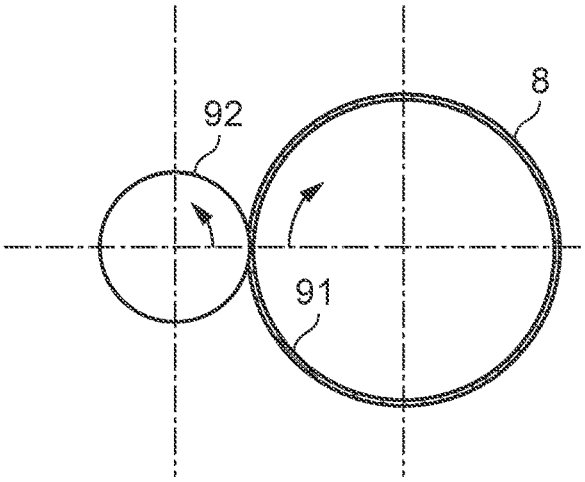
FIG. 8A is a conceptual cross-sectional view of an imprint processing device.

FIG. 8A is a conceptual cross-sectional view of an imprint processing device in the exemplary embodiment of the present disclosure.

Figure 8B:
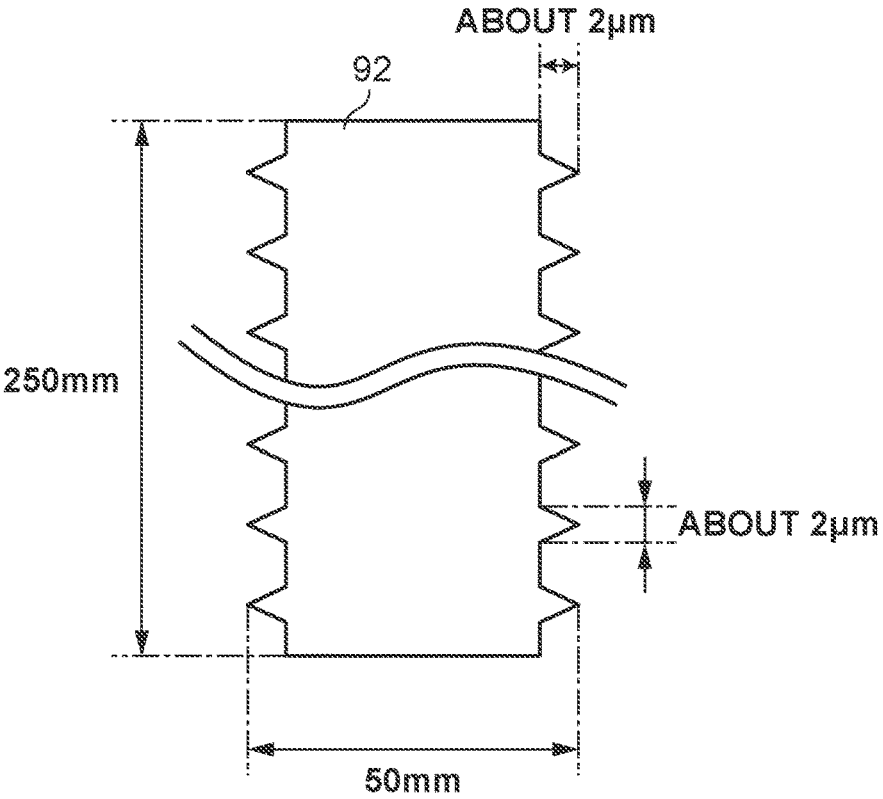
FIG. 8B is a conceptual cross-sectional view of a die used in imprint processing, in the exemplary embodiment of the present disclosure.

FIG. 8B is a conceptual cross-sectional view of a die used in the imprint processing.

Specifically, FIG. 8A illustrates the imprint processing device when viewed in the cylindrical shaft direction of the intermediate transfer belt 8. FIG. 8B illustrates a cross-section in one direction along the cylindrical shaft of the die used in the imprint processing.

In the imprint processing, first, the intermediate transfer belt 8 with the outer layer 82 formed on the base layer 81 is press-fit onto a core 91 (having a diameter of 227 mm, and made of carbon tool steel).

A die 92 shaped like a cylinder and having a diameter of 50 mm and a length of 250 mm is brought into pressure contact with the surface of the press-fit intermediate transfer belt 8 with a predetermined pressing force of about 1000 N to 2500 N (total pressure). As illustrated in FIG. 8B, wedge-shaped projections each having a projection bottom length of about 2 μm and a height of about 2 μm are formed at predetermined intervals on the surface of the die 92 parallel to the circumferential direction of the cylinder, by cutting work.

The groove pitch (the number of grooves in the outer layer) on the intermediate transfer belt 8 can be changed depending on the distance between the projections.

Using the die 92 of the present exemplary embodiment can produce a maximum groove pitch of 250 mm (a minimum groove number of 0.004 per 1-mm width in the width direction of the intermediate transfer belt 8), and a minimum groove pitch of 2 μm (a maximum groove number of 500 per 1-mm width in the width direction of the intermediate transfer belt 8) on the outer layer 82.

The minimum groove pitch can be further shortened with a projection bottom length of 2 μm or less, but the strength of the projection can be insufficient, bringing about deformation in the imprint processing. It thus is suitable that the minimum groove pitch is kept at 2 μm, and the maximum groove number per unit length is kept at 500/mm.

The die 92 is heated to a temperature of about 130° C. by a heater (not illustrated). Further, the core 91 is turned one rotation at a circumferential velocity of 264 mm/s in the contact state while the die 92 follows this rotation. Subsequently, the die 92 is moved away, and the intermediate transfer belt 8 with the microgroove shape in the surface of the outer layer 82 is obtained.

(Influence of Adhesion of Foreign Substance on Intermediate Transfer Belt Configuration in Processing)

If the imprint processing is performed with a foreign substance such as dust or fluff in the air on a portion between the intermediate transfer belt 8 and the core 91 in the process of forming the groove shape by the imprint processing, a dent can be formed in the surface of the core 91.

Meanwhile, the surface of the core 91 can be damaged due to carelessness in making press-fit of and taking out the intermediate transfer belt 8 onto and from the core 91.

The portion of the dent formed in the core 91 is less likely to receive an appropriate pressing force when the die 92 is press-fit, which results in a groove shape shallower than in other normal areas (i.e., "grooving defective portion" can be formed).

The microgroove of such a "grooving defective portion" can reduce the irregular reflection effect by itself compared with other normal microgrooves, which results in an increase in the amount of regularly reflected light. As a result, stronger regularly reflected light from the belt surface as the base with a calibration patch formed on the grooving defective portion prevents the amount of reflected light to be reduced by the toner from being sufficiently reduced. This can prevent accurate detection of the position of the toner image, leading to a lower accuracy of the position detection.

In the present exemplary embodiment, a plurality of minute vertical grooves each serving as a first groove is also formed in the surface of the base layer 81, to reduce an increase in the amount of reflected light at the grooving defective portion.

Next, the details of microgroove processing on the surface of the base layer 81 will be described with reference to FIG. 9.

Figure 9:
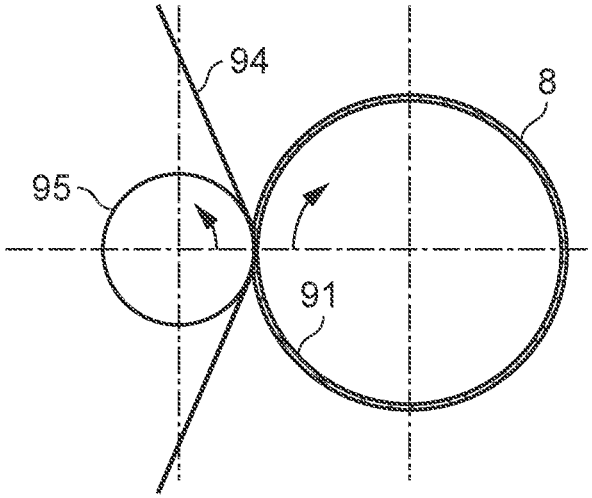
FIG. 9 is a conceptual cross-sectional view of a lapping film processing device in the exemplary embodiment of the present disclosure.

FIG. 9 is a conceptual cross-sectional view of a lapping film processing device in the exemplary embodiment of the present disclosure.

Specifically, FIG. 9 illustrates the microgroove processing device using a lapping film when viewed in the cylindrical shaft direction of the intermediate transfer belt 8.

In the microgroove processing on the base layer 81, the base layer 81 that has a seamless belt shape and is obtained by extrusion processing is press-fit onto a core 91 (having a diameter of 227 mm, and made of carbon tool steel). While a lapping film 94 is fed at a speed of 4 mm/s in a state where the lapping film 94 is pressed against the press-fit base layer 81 at a force of 0.2 N/mm$^2$ with a backup roller 95 (having a diameter of 50 mm, and made of rubber), the core 91 is turned a little more than one rotation at a circumferential velocity of 264 mm/s. Subsequently, the backup roller 95 is moved away, and the base layer 81 with the microgroove shape on the surface is obtained.

The outer layer 82 is formed on the processed base layer 81, and the imprint processing is performed, so that the intermediate transfer belt 8 with the configuration of the present exemplary embodiment is obtained.

(Evaluation Method)

[Number of Grooves (Average Pitch)]

The microgroove shapes obtained by the imprint processing and the lapping film processing were measured using a laser microscope VK-X250 (manufactured by KEYENCE CORPORATION).

The number of grooves in the base layer 81 was obtained by observing a reflection image from the base layer surface using the intermediate transfer belt 8 before the outer layer 82 was formed.

The number of grooves in the outer layer 82 was obtained by observing a reflection image from the surface of the outer layer 82 after the imprint processing.

The areas measured for the number of grooves were two locations in the width direction Z3 with respect to four phases in the circumferential direction Z, i.e., eight locations in total, in a range of a width of about 2 mm at both of positions 100 mm away from the central position in the width direction Z3, the range of which is the first area 275 of the intermediate transfer belt 8.

The measurement conditions included using a ×150 object lens to measure an area of about 70×90 μm. The number of grooves present in a width of 90 μm was measured, and the quotient for the width of 90 μm was calculated, so that the average pitch of the grooves and the number of grooves possible to be present in a width of 1 mm were obtained.

The number of grooves in the base layer 81 can also be obtained by cutting the intermediate transfer belt 8 in the thickness direction with a razor or another cutting tool, and observing the obtained cross-section using an electronic microscope after the outer layer 82 is formed.

[Groove Depth (Average Groove Depth)]

Measurement of an average groove depth (hereinafter may simply be referred to as "groove depth") will be described.

Specifically, after the same area as the area measured for the number of grooves was similarly measured, a measurement line perpendicular to the groove direction in a line profile measurement mode was drawn on the obtained two-dimensional height information, and using the peak at which the height between adjacent vertical grooves is maximum, the height to the groove bottom was measured, so that the groove depth for each groove was obtained.

Some grooves in the outer layer 82 can be processed bulging at the groove end portions as illustrated in FIG. 7A. For a groove with a bulging shape, a groove depth d2 was obtained using the higher of both ends as the peak. Further, a groove without bulging shape at any groove end portion as illustrated in FIG. 7B, the groove depth d2 of the groove was obtained by measuring the height to the groove bottom, using the higher of the flat end portions on both sides as the peak.

For the groove depth of the base layer 81 obtained by the lapping film processing, no tendency for both ends to bulge was observed. The groove depth d1 of each groove was obtained by measuring the height to the groove bottom using the higher one of the flat end portions on both sides as the peak, as with the grooves of the outer layer 82 in FIG. 7B.

The groove depth measurement was made on all the grooves in a field of vision of about 70×90 μm, and the average of all the measured depths at eight locations was taken, so that the average groove depth d1 and the average groove depth d2 were obtained.

The groove depth d1 of the base layer 81 can also be obtained by cutting the intermediate transfer belt 8 in the thickness direction with a razor or another cutting tool, and observing the obtained cross-section using an electronic microscope after the outer layer 82 is formed.

[20-Degree Gloss Value]

Japanese Industrial Standard Z8741 (JIS Z8741) is a standard that specifies a method of measurement for specular glossiness of a macroscopically smooth surface of a product. The reflection property of the intermediate transfer belt 8 was evaluated using a 20-degree gloss value based on JIS Z8741. The 20-degree gloss value was measured using a surface reflectance analyzer RA-532H (manufactured by Canon Inc.).

[Amount of Error Detection in Position Detection]

Figure 10A:
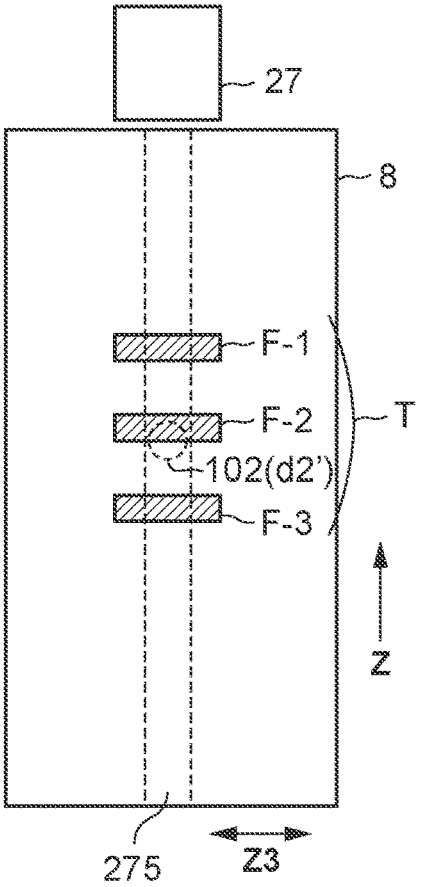
FIG. 10A is a conceptual diagram illustrating the positional relationship between a position detection pattern and a grooving defective portion in each of examples according to the exemplary embodiment of the present disclosure and comparative examples.
Figure 10B:
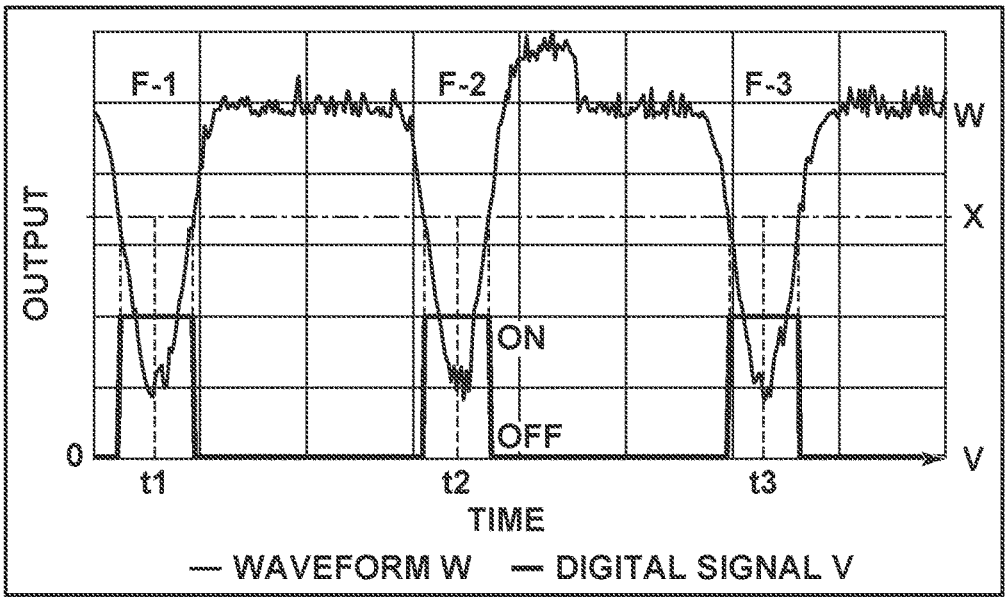
FIG. 10B is a conceptual diagram illustrating the correspondence relationship between the position detection pattern and an output waveform from the optical sensor.

Next, the influence of a grooving defective portion 102 on position detection of the calibration patch T was evaluated by a method illustrated in FIGS. 10A and 10B.

FIG. 10A is a conceptual diagram illustrating the positional relationship between the grooving defective portion and a position detection pattern in each of examples according to the exemplary embodiment of the present disclosure and comparative examples. FIG. 10B is a conceptual diagram illustrating a correspondence between the position detection pattern and an output waveform from the optical sensor.

Specifically, FIG. 10A illustrates the positional relationship between the optical sensor 27, the calibration patch T, and the grooving defective portion 102. FIG. 10B illustrates the output of the optical sensor 27 obtained when the intermediate transfer belt 8 and the calibration patch T illustrated in FIG. 10A are read.

In FIG. 10A, the optical sensor 27 is disposed at each of the positions 100 mm away from the central position of the intermediate transfer belt 8 in the width direction, but one side is illustrated for simplification.

As the calibration patch T, three patches F-1, F-2, and F-3 as a position detection pattern in the sub scanning direction Z were formed. The patches F-1 to F-3 are formed on the intermediate transfer belt 8 as yellow toner images at intervals of 6 mm in the sub scanning direction Z. The yellow toner images each have sizes of 10 mm in the main scanning direction Z3 and 2 mm in the sub scanning direction Z.

In the present exemplary embodiment, an evaluation experiment was performed on the grooving defective portion 102 as a portion having a size of about 2 mm. Specifically, to form the grooving defective portion 102, first, a dent (a defective shape) having a size of about 2 mm was formed at a position corresponding to the reading unit of the optical sensor 27, on the core 91. Subsequently, a second area (the grooving defective portion 102) where an average groove depth d2' was shallower than the average groove depth d2 of the other normal portions was formed on the surface of the intermediate transfer belt 8 by the imprint processing.

Thus, the intermediate transfer belt 8 having the grooving defective portion 102 serving as the second area where the groove depth is shallower than in the other areas (d2' <d2) in the first area 275 can be intentionally formed.

Next, for the grooving defective portion 102, the position detection pattern F-2 was formed as an image covering the area of exactly half of the grooving defective portion 102.

As illustrated in FIG. 10B, the waveform W is an output waveform obtained when the intermediate transfer belt 8 and the position detection pattern F-1 to F-3 were read by the optical sensor 27.

At the position detection pattern F-2, the time period in which the output is low had a tendency to be shorter, and the output immediately after the position detection pattern F-2 had a tendency to be extremely high.

This phenomenon occurred because, in the grooving defective portion, the irregular reflection effect by the micro-groove decreased, and the amount of regularly reflected light increased, so that the amount of light received by the regularly reflected light receiving element 273 increased.

The amount of reflected light from the belt base at the area of the position detection pattern overlapping the grooving defective portion is very high, changing the relationship between the sensor output and the amount of toner illustrated in FIG. 3, producing a high sensor output even with the same amount of toner as before the change.

As a result, the time period in which the output (the waveform W) was low was shortened in the position detection pattern F-2.

Meanwhile, as illustrated in FIG. 10B, the signal V is a digital signal indicating the result of determining ON/OFF of the waveform W using the comparison circuit based on a threshold X.

As described above, the timing of half of the time period in which the digital signal V is ON is detected as each of timings t1 to t3 at which the position detection pattern F-1 to F-3 are detected by the optical sensor 27. Subsequently, differences df1 to df3 in the respective patterns were calculated based on differences between the ideal timings t1' to t3'.

To evaluate the influence of the grooving defective portion 102 on the position detection of the calibration patch T, the amount of error detection in position detection due to the influence of the grooving defective portion was calculated by taking the difference between (df1+df3)/2, which is the average of the differences of the pattern F-1 and F-3 having no defective portion, and df2.

In the present exemplary embodiment, if the amount of error detection in position detection caused by the grooving defective portion is 80 μm or more, the difference of each color is not acceptable. The acceptability was determined with 80 μm (less than 80 μm) as a threshold.

EXAMPLES

The operation and effect of the present exemplary embodiment will be described with reference to Examples 1 to 7 and Comparative Examples 1 to 4. Table 1 illustrates the grooving condition, the number of grooves, and the average groove depth d1 in the base layer. Table 1 further illustrates the number of grooves, the average groove depth d2, and the 20-degree gloss value in the outer layer. Table 1 further illustrates the groove depth d2', the amount of error detection in position detection, and the difference (acceptability) determination result in the grooving defective portion of the outer layer, as well as the frictional resistance determination result of the outer layer (the surface).

TABLE 1

Grooving Conditions and Evaluation Results

| | | Ex 1 | Ex 2 | Ex 3 | Ex 4 | Ex 5 | Ex 6 | Ex 7 | Comp Ex 1 | Comp Ex 2 | Comp Ex 3 | Comp Ex 4 |
|---|---|---|---|---|---|---|---|---|---|---|---|---|
| Base layer | Abrasive grain size (μm) | 2 | 9 | 1 | 2 | 2 | 2 | 2 | None | 20 | None | 2 |
| | Number of grooves (per mm) | 208 | 80 | 500 | 208 | 208 | 208 | 208 | | 42 | | 208 |
| | Average groove depth dl (μm) | 0.33 | 0.5 | 0.2 | 0.33 | 0.33 | 0.33 | 0.33 | | 0.59 | | 0.33 |
| Outer layer | Number of grooves (per mm) | 260 | 260 | 260 | 500 | 160 | 260 | 260 | 260 | 260 | 100 | None |
| | Average groove depth d2 (μm) | 0.5 | 0.5 | 0.5 | 0.5 | 0.5 | 0.98 | 0.2 | 0.5 | 0.5 | 0.5 | |
| | 20-degree gloss value | 10 | 10 | 10 | 8 | 30 | 5 | 40 | 10 | 10 | 46 | 58 |
| Outer layer grooving defective portion | Average groove depth d2' (μm) | 0.04 | 0.04 | 0.04 | 0.03 | 0.04 | 0.07 | 0.02 | 0.04 | 0.04 | 0.05 | 0 |
| | Amount of position error detection (μm) | 53 | 54 | 48 | 60 | 46 | 62 | 44 | 123 | 112 | 49 | 29 |
| | Difference acceptability determination | Pass | Pass | Pass | Pass | Pass | Pass | Pass | Fail | Fail | Pass | Pass |
| Outer layer surface | Frictional resistance determination | Pass | Pass | Pass | Pass | Pass | Pass | Pass | Pass | Pass | Fail | Fail |

Examples 1 to 3

In Examples 1 to 3, while the same imprint processing condition applied to the outer layers, the size of lapping film abrasive grain to be used in processing of the base layer was changed to 2 μm, 9 μm, and 1 μm. In each of Examples 1 to 3, the amount of error detection attributable to the grooving defective portion is less than 80 μm, and thus is acceptable.

In the present exemplary embodiment, the regularly reflected light from the base layer surface 811 is reduced at the grooving defective portion, which can reduce the influence of the grooving defective portion on the output waveform W of the optical sensor.

Specifically, the outer layer 82 having the configuration of the present exemplary embodiment is a transparent acrylic resin layer, so that the incident light striking the surface of the intermediate transfer belt 8 is reflected by the outer layer surface 821, and also reflected by the base layer surface 811 to pass through the outer layer surface 821 again in the regularly direction. In Examples 1 to 3 of the present exemplary embodiment, it is conceivable that, as a result of the microgroove processing on the base layer surface 811 under each appropriate condition, the transmitted light was irregularly reflected by the microgrooves (the first grooves 81*m*), significantly reducing the regularly reflected light.

Thus, the configuration of each of Examples 1 to 3 efficiently prevented the reduction in the position detection accuracy for the calibration patch T due to the influence of the grooving defective portion.

In addition, in Examples 1 to 3, conditions such as the pressure and the speed in the lapping film processing were constant. Under the conditions, it was found that the number of grooves tends to decrease and the groove depth tends to increase as the abrasive grain size increases.

From the results of Examples 1 to 3, it was confirmed that the reduction in the position detection accuracy for the calibration patch T due to the influence of the grooving defective portion was prevented in a range in which the number of the microgrooves (the first grooves 81*m*) in the base layer surface 811 was 80 or more per 1-mm width (length) in the width direction of the intermediate transfer belt 8.

The number of the microgrooves in the base layer surface can be increased to more than 500/mm (500 per 1-mm length in the width direction of the intermediate transfer belt 8) by lapping film processing with an abrasive grain size of less than 1 μm. However, such a small abrasive grain size can cause the groove depth to be a shallow depth of 0.1 μm or less. Thus, it is suitable that the number of microgrooves 81*m* in the base layer surface 811 in the lapping film processing method is limited to 500/mm or less for a stable groove shape extending in the circumferential direction Z. In addition, an average groove depth of the first grooves 81*m* can be in the range of 0.2 μm to 0.5 μm when the number of the first grooves 81*m* is 80 to 500 per 1-mm width (length) in the width direction of the intermediate transfer belt 8.

Comparative Examples 1 and 2

In Comparative Examples 1 and 2, the same imprint processing conditions as those of Examples 1 to 3 applied to the outer layer 82. However, in Comparative Example 1, the lapping film processing was not performed on the base layer 81. Further, in Comparative Example 2, the lapping film abrasive grain size was changed to 20 μm.

In both of Comparative Examples 1 and 2, the amount of error detection attributable to the grooving defective portion is 80 μm or more, which is unacceptable.

In the configuration of Comparative Example 1, it is conceivable that, due to no microgroove processing on the base layer 81, incident light passing through the outer layer 82 was regularly reflected with great intensity by the base layer surface 811, and traveled as regularly reflected light, together with light reflected from the outer layer surface 821.

Thus, in Comparative Example 1, it is conceivable that the amount of light received by the regularly reflected light receiving element 273 increased in the area overlapping the grooving defective portion in the thickness direction, and the time period in which the output W is low in the position detection pattern F-2 (see FIG. 10B) was short (in comparison with the F-1 and F-3), so that the difference of the timing t2 with respect to the timing t2' increased, which caused the erroneous detection of the position of the position detection pattern F-2.

Further, in the configuration of Comparative Example 2, conditions such as the pressure and the speed in the lapping film processing were constant as in Examples 1 to 3. Under the conditions, an increased abrasive grain size of 20 μm tends to cause the number of grooves in the base layer surface 811 to be reduced and the groove depth thereof to be increased.

As a result, while the number of the base layer grooves 81*m* in each of Examples 1 to 3 was 80/mm to 500/mm, this number was reduced to 42/mm in Comparative Example 2. It is conceivable that, in Comparative Example 2, the decrease in the number of the grooves 81*m* reduced the irregular reflection action by the grooves decreased (regular reflection was not reduced), so that effects equivalent to the effects of Examples 1 to 3 were not seen.

From the results of Comparative Examples 1 and 2, it was found that conditions where the number of the grooves 81*m* in the microgroove processing on the base layer surface 811 is less than 80 per 1-mm width (length) in the width direction of the intermediate transfer belt 8 make it difficult to prevent the reduction in the position detection accuracy for the calibration patch T due to the influence of the grooving defective portion. In other words, to maintain the position detection accuracy, it is suitable that at least 80 or more grooves per 1-mm width (length) in the width direction of the intermediate transfer belt 8 are formed as the grooves 81*m* in the base layer surface 811.

Examples 4 to 7

In Examples 4 and 5, while the lapping film processing condition for the base layer 81 was the same as that in Example 1, the projection interval of the die 92 for the imprint processing on the outer layer 82 was changed. In the configuration of each of Examples 4 and 5, the amount of error detection attributable to the grooving defective portion is 80 μm or less, which is acceptable.

Further, in Examples 6 and 7, while the lapping film processing condition for the base layer 81 was the same as that in Example 1, the pressure in the imprint processing on the outer layer 82 was adjusted. In the configuration of each of Examples 6 and 7 in which the depth of the groove 82*m* in the outer layer 82 was changed with the pressure in the imprint processing, the amount of error detection attributable to the grooving defective portion is also 80 μm or less, which is acceptable.

It was also found that, in comparison between the amounts of error detection in Examples 1, 4, and 5, as the number of the grooves 82*m* in the outer layer 82 (e.g., Example 5) was smaller, the amount of error detection also was smaller. In addition, as the number of the grooves 82*m* in the outer layer 82 is smaller (e.g., Example 5), the 20-degree gloss value of the outer layer tends to be higher.

This indicates such a tendency that a smaller number of the grooves 82*m* of the outer layer 82 results in a less irregular reflection from the outer layer grooves and a more regular reflection from the outer layer. Thus, it is conceivable that this leads to a smaller difference between the grooving defective portion and the normal portion in terms of the amount of regularly reflected light, resulting in a relatively small amount of error detection in position detection.

Similarly, it was found that, in comparison between Examples 1, 6, and 6, the amount of error detection is also relatively smaller as the groove depth d2 of the outer layer 82 is shallower (e.g., Example 7). In addition, as the groove depth d2 of the outer layer 82 is shallower (e.g., Example 7), the 20-degree gloss value of the outer layer 82 tends to be higher.

This indicates such a tendency that a shallower depth of the groove 82*m* of the outer layer 82 results in a less irregular reflection from the outer layer grooves, and a more regular reflection from the outer layer. Thus, it is conceivable that this leads to a smaller difference between the grooving defective portion and the normal portion in terms of the amount of regularly reflected light, resulting in a relatively small amount of error detection in position detection.

In addition, with the configuration of Example 4 in which the number of the grooves 82*m* in the outer layer 82 is large and the configuration of Example 6 in which the depth d2 of the groove 82*m* in the outer layer 82 is large, the irregular reflection from the outer layer grooves tends to be large while the regular reflection from the outer layer tends to be weak. As a result, it is conceivable that this leads to a larger difference between the grooving defective portion and the normal portion in terms of the amount of regularly reflected light resulted in a remarkable amount of error detection. However, the configuration of each of Example 4 and Example 6 effectively prevented the reduction in the position detection accuracy for the calibration patch T due to the influence of the grooving defective portion in comparison with Comparative Example 1 in which the grooving was not performed on the base layer 81.

From the results of Examples 1, 4, and 5, it was confirmed that the reduction in the position detection accuracy for the calibration patch T due to the influence of the grooving defective portion was more effectively prevented in the range in which the number of the microgrooves (the second grooves 82*m*) in the outer layer surface 821 is 160 to 500 per 1-mm width (length) in the width direction.

As described above, when the number of the microgrooves 82*m* in the outer layer surface 821 is more than 500/mm, the effect of preventing the reduction in the detection accuracy can be seen, but it is also conceivable that this configuration could cause an insufficient strength of the projection on the die, resulting in a deformation in the imprint processing. Thus, in the present exemplary embodiment, it is suitable to keep the number of the grooves 82*m* per unit length at 500/mm or less.

Further, from the results of Examples 1, 6, and 7, it was confirmed that the reduction in the position detection accuracy for the calibration patch T due to the influence of the grooving defective portion depth can be more effectively prevented in the range in which the depth of the microgroove 82*m* in the outer layer surface 821 is 0.2 μm to 1.0 μm.

When the depth of the microgroove 82*m* in the outer layer surface 821 is greater than 1.0 μm, the effect of inhibiting the reduction in the detection accuracy can be seen, but it is conceivable that a too large depth of the groove is more likely to cause an outer layer crack (break) in the groove bottom. Thus, in the present exemplary embodiment, it is suitable to keep the depth of the groove 82*m* at 1 μm or less.

Further, from the results of Examples 5 and 7, it was found that the conditions that the number of the microgrooves 82*m* of the outer layer surface 821 is small and the depth is shallow resulted in a small reduction in the position detection accuracy for the calibration patch T due to the influence of the grooving defective portion.

Comparative Examples 3 and 4

In Comparative Example 3, as with Comparative Example 1, the projection interval of the die 92 of the imprint processing on the outer layer 82 was increased without the lapping film processing on the base layer 81. In the configuration of Comparative Example 3, the amount of error detection attributable to the grooving defective portion is less than 80 μm, which is acceptable.

In Comparative Example 4, the configuration in which the lapping film processing condition that applies to the base layer 81 is the same as that in Example 1, and the imprint processing on the outer layer 82 is not performed. In Comparative Example 4 as well, the amount of error detection attributable to the grooving defective portion is 80 μm or less, which is acceptable.

It was found that, in comparison between Examples 1, 4, 5, and Comparative Example 3 in terms of the 20-degree gloss value of the outer layer 82, Comparative Example 3 shows the highest 20-degree gloss value.

This is related to the conditions that, in Comparative Example 3, the number of the grooves 82*m* in the outer layer 82 is small, and the irregular reflection by the outer layer grooves is small, as in Examples 1, 4, and 5, resulting in a tendency of a strong regular reflection from the outer layer 82 in Comparative Example 3. As a result, it is conceivable that the small difference between the grooving defective portion and the normal portion in terms of the amount of regularly reflected light in Comparative Example 3 led to the small reduction in the position detection accuracy even without the microgroove processing on the base layer 81.

In addition, the 20-degree gloss value in Comparative Example 4 indicates the highest numerical value of 58 since the imprint processing on the outer layer 82 was not performed. In other words, it was found that the maximum value of the 20-degree gloss value of the outer layer 82 at the grooving defective portion is 58, supposing that the groove depth is 0.

In the present exemplary embodiment, the size of the grooving defective portion is 2 mm, which makes it difficult to measure the gloss value directly. In Examples 1 to 7 of the present exemplary embodiment and Comparative Examples 1 to 3, a belt having a groove depth equal to the groove depth of the grooving defective portion was made with a reduced total-pressure in the imprint processing, and the 20-degree gloss value was measured. As a result, the gloss value of the belt surface corresponding to the grooving defective portion is about 46 to 54.

Thus, in the configuration of Comparative Example 3 in which the 20-degree gloss value of the outer layer 82 subjected to the imprint processing is 46, the difference between the grooving defective portion and the normal portion in terms of the amount of regularly reflected light is small. For this reason, it is conceivable that, even if the grooving defective portion and the position detection pattern overlap each other in the thickness direction, a change in the output waveform W of the optical sensor is small in the overlap area, and erroneous detection of the position detection pattern does not likely occur.

From the results of Comparative Examples 3 and 4, it was found that, with the number of the grooves 82*m* less than 160/mm in the microgroove processing on the outer layer surface 821, including the configuration in which the microgroove processing is not performed (the groove number per 1-mm width in the width direction of the intermediate transfer belt 8 is 0), the reduction in the position detection accuracy for the calibration patch T due to the influence of the grooving defective portion is small.

Further, from the results of Example 7 and Comparative Examples 3 and 4, it was found that the reduction in the position detection accuracy is also small with the 20-degree gloss value of the outer layer surface 821 over 40.

However, it is apparent from the frictional resistance determination results in Comparative Examples 3 and 4 that, with the number of the grooves 82*m* of the outer layer 82 is less than 160/mm, the coefficient of friction against the cleaning blade is large, and a defect such as a blade squeak is likely to occur.

As described above, in the present exemplary embodiment, it is suitable that the number of the grooves 82*m* in the microgroove processing on the outer layer surface 821 is 80/mm to 500/mm in the width direction Z3. Meanwhile, it is suitable that the number of the grooves 81*m* in the microgroove processing on the base layer surface 811 is 80 per 1-mm width (length) or more in the width direction Z3.

In addition, the configuration in which the 20-degree gloss value exceeds 40 in the area where the imprint processing is performed has a high coefficient of friction against the cleaning blade similarly, making a blade squeak more likely to occur. Thus, it is suitable that the 20-degree gloss value of the area where the imprint processing is performed is 40 or less. Moreover, with the gloss value of the grooving defective portion greater than 40, the difference between the grooving defective portion and the normal portion of the area where the imprint processing is performed is large in terms of the amount of regularly reflected light, making it conceivable that a reduction in the position detection accuracy for the calibration patch is likely to occur.

According to the exemplary embodiment of the present disclosure, the configuration brings about a less reduction in the position detection accuracy for the calibration patch due to the grooving defective portion in the intermediate transfer belt with microgrooves in its surface. In other words, this maintains the surface frictional resistance of the intermediate transfer belt low, and provides a high accuracy of the detection by the optical sensor.

While the present disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2021-164692, filed Oct. 6, 2021, which is hereby incorporated by reference herein in its entirety.

What is claimed is:

1. An intermediate transfer belt having an endless shape and configured to bear a toner image, the intermediate transfer belt comprising:

a first layer that includes a first surface located on an outer peripheral surface side of the first layer; and a second layer that is provided on a side of the first surface, is configured to transmit light, and includes a second surface, wherein the first surface includes a plurality of first grooves that (i) extends in a first direction in a circumferential direction of the intermediate transfer belt and (ii) is arranged in a width direction of the intermediate transfer belt that is orthogonal to the circumferential direction, wherein the second surface is located on an outer peripheral surface side of the second layer, is configured to be in contact with a toner image, and includes a plurality of second grooves that extends in a second direction in the circumferential direction, and wherein the plurality of first grooves includes 80 or more grooves per 1-mm length in the width direction in the first surface.

2. The intermediate transfer belt according to claim 1, wherein an average groove depth of the plurality of first grooves is in a range of 0.2 μm to 0.5 μm.

3. The intermediate transfer belt according to claim 1, wherein an average groove depth of the plurality of second grooves is in a range of 0.2 μm to 1 μm.

4. The intermediate transfer belt according to claim 1, wherein an average groove depth of the plurality of first grooves is less than an average groove depth of the plurality of second grooves.

5. The intermediate transfer belt according to claim 1, wherein the plurality of first grooves is formed in the first surface by lapping film processing.

6. The intermediate transfer belt according to claim 1, wherein the plurality of second grooves is formed in the second surface by imprint processing.

7. The intermediate transfer belt according to claim 1, wherein the plurality of second grooves includes 160 to 500 grooves per 1-mm length in the width direction in the second surface.

8. The intermediate transfer belt according to claim 1, wherein, in a case of measuring a reflection property of the intermediate transfer belt using a 20-degree gloss value based on Japanese Industrial Standard Z8741 (JIS Z8741), the 20-degree gloss value measures 40 or less.

9. The intermediate transfer belt according to claim 1, wherein the first direction and the second direction are an identical direction.

10. An image forming apparatus comprising:

an image bearing member configured to bear a toner image;

the intermediate transfer belt according to claim 1; and a transfer member configured to transfer the toner image borne on the image bearing member from the image bearing member to the intermediate transfer belt.

11. The image forming apparatus according to claim 10, further comprising an optical sensor configured to detect the toner image transferred from the image bearing member to the intermediate transfer belt, wherein the intermediate transfer belt includes a first area having a predetermined width in the width direction, wherein the first groove and the second groove are formed in an area corresponding to the first area, and wherein, in detecting the transferred toner image, the optical sensor performs detection in the circumferential direction in the first area of the intermediate transfer belt.

12. The image forming apparatus according to claim 11, wherein the second surface has a second area and the plurality of first grooves of the first surface is formed in an area corresponding to the second area, and wherein the second area is inside an area corresponding to the first area and is an area in which an average groove depth of the plurality of second grooves is less than 0.2 μm.

13. The image forming apparatus according to claim 12, wherein, in a case of measuring a reflection property of the second area of the intermediate transfer belt using a 20-degree gloss value based on Japanese Industrial Standard Z8741 (JIS Z8741), the 20-degree gloss value measures greater than 40.

* * * * *